US005655588A

United States Patent [19]

Lamont et al.

[11] Patent Number: 5,655,588

[45] Date of Patent: Aug. 12, 1997

[54] ANGLED VALANCES

[75] Inventors: Bernard Lamont, Gatineau; David Rozon, Russell, both of Canada

[73] Assignee: 2844788 Canada Ltée, Hull, Canada

[21] Appl. No.: 643,876

[22] Filed: May 7, 1996

[51] Int. Cl.[6] ..... E06B 9/00

[52] U.S. Cl. ..... 160/38

[58] Field of Search ..... 160/38, 39, 19, 160/21, 178.1 V, 900

[56] References Cited

U.S. PATENT DOCUMENTS

| | | | |
|---|---|---|---|
| 224,466 | 2/1880 | Murphey | 160/39 |
| 232,838 | 10/1880 | Murphey | 160/39 |
| 1,070,842 | 8/1913 | Prescott | 160/39 |
| 2,342,893 | 2/1944 | Prucell et al. | 160/38 |
| 2,570,731 | 10/1951 | Susnow | 160/19 X |
| 2,888,983 | 6/1959 | Toti | 160/38 |
| 2,894,571 | 7/1959 | Toti | 160/38 |
| 3,007,036 | 10/1961 | Mills | 160/38 X |
| 3,297,075 | 1/1967 | Howell et al. | 160/38 X |
| 3,302,350 | 2/1967 | Brown et al. | 52/287 |
| 3,956,861 | 5/1976 | Rasmussen | 52/287 |
| 4,935,988 | 6/1990 | Ford et al. | 160/38 X |
| 5,001,877 | 3/1991 | Edwards | 52/288 |
| 5,199,237 | 4/1993 | Juntunen | 52/288 |
| 5,383,508 | 1/1995 | Pavlica et al. | 160/38 |
| 5,444,956 | 8/1995 | Searer et al. | 52/312 |

FOREIGN PATENT DOCUMENTS

| | | | |
|---|---|---|---|
| 899589 | 5/1972 | Canada | 20/94 |
| 1182975 | 2/1985 | Canada | 20/96 |

*Primary Examiner*—David M. Purol
*Attorney, Agent, or Firm*—Adrian Zahl

[57] ABSTRACT

The invention is a decorative valance, consisting of a box-like structure made up of rigid front and side panels. The panels are canted outwardly an upwardly away from the vertical by about 45 degrees. The panels may each consist of generally channel-shaped retainer member adapted to releasably receive a decorative insert within the channel. The corners of the structure may be each capped with a corner cap that snap locks to the retainer members. The invention further consists of mount for the valance, adapted to mount the valance to a window blind support bracket, with the mount being slideably engaged to a corresponding panel.

7 Claims, 5 Drawing Sheets

ANGLED VALANCES

FIELD OF THE INVENTION

The present invention relates to decorative valances comprised of rigid panel members in a box-like arrangement, intended primarily for installation over window blinds or drapes.

BACKGROUND OF THE INVENTION

Traditional valances consist of a generally box-like structure defined by generally vertical front and side members. The members may comprise fabric, often in a pleated arrangement, engaged to a frame or may alternatively be assembled from rigid generally planar panels. Valances of this latter type are referred to herein as "rigid panel valances". The aesthetic appeal of rigid panel valances may be enhanced by the use of lengths of window blind vanes or the like being inserted into channels within the panels or otherwise retained by the structure. For example, U.S. Pat. Nos. 5,383,508 (Pavlica et al.), 2,888,983 (Toti) and 2,894,571 (Toti) disclose various arrangements of this type. This arrangement permits the user to change the appearance of the valance to reflect changes in decor of the house and provides a means to co-ordinate the valance with blinds or drapes.

The rigid panel members of a valance may comprise adaptations of moulding elements of the type disclosed in the present applicant's U.S. patent application Ser. No. 08/685,021. This type of member is adapted to releasably retain a decorative panel insert. The insert is bowed in either a convex or concave position both for aesthetic purposes and, in the case of a relatively flexible insert, to retain the insert without sagging or inadvertent release thereof.

An aesthetic limitation of traditional valances is their use of generally vertical panels; it is desirable to provide the option of canted panels that have an appearance akin to crown mouldings or cornices. As well, it is desirable to provide corner caps that give an aesthetically pleasing appearance to the valance and that are specifically adapted for use with decorative inserts that are retained within the front and side valance panels. Traditional corner members of the type used with moulding require the abutting elements to be trimmed to precisely fit against the corner member. While it is known to use a cap element that covers the free end of moulding elements in order to eliminate the need for precise trimming, as in U.S. Pat. No. 5,199,237 (Juntunen), this arrangement requires the cap to be glued or otherwise fixed more or less permanently to the underlying moulding and thus does not permit a decorative strip to be readily replaced.

As well, there is need for an improved mounting system that permits rigid panel valances to be readily mounted to a wall or window blind.

In light of the above, it is an object of this invention to provide an aesthetically pleasing rigid panel valance wherein the panels are canted outwardly and upwardly away from the vertical.

As well, it is an object to provide a rigid panel valance with an improved corner cap that permits the use of replaceable decorative inserts within the valance panels, with the cap easily and releasably attaching to the panels without the requirement that the inserts be precisely trimmed or glued into position.

It is a further object to provide an improved mounting system for attaching a rigid panel valance to a wall or ceiling.

SUMMARY OF THE INVENTION

In light of the objects recited above, the present invention comprises a rigid panel valance, consisting of a box-like structure made up of front and side panels. The panels are canted outwardly an upwardly away from the vertical by about 45 degrees.

In a preferred embodiment, the panels each comprise a generally channel-shaped retainer member adapted to releasably receive a decorative insert within the channel. The channel is shaped to accommodate an insert comprising an elongate striplike sheet flexed either convexly or concavely about its elongate axis, relative to the retainer member. The corners of the structure may be each capped with a corner cap. The cap comprises a generally L-shaped member, when seen in plan view, having upper and lower edges and a faceplate extending between the edges. The upper and lower edges incorporate snap-lock engagement means adapted to engage corresponding engagement means in the retainer members. The faceplate is adapted to maintain a spaced-apart relation with the underlying retainer members sufficient to permit a decorative insert to be slideably received between the faceplate and the retainer member. The ends of corner cap may be cut either parallel to each other to present an angled appearance or angling away from each other to provide a square-cut appearance when mounted to the valance. The faceplate of the corner caps may bulge inwardly or outwardly, to accommodate a concavely or convexly-flexed decorative insert, respectively.

The invention further comprises a mount for the valance, adapted to mount the valance to a window blind support bracket. The mount consists of a generally L-shaped bracket having means to slideably engage upper and lower edges of one of the panels. The engagement means may comprise inwardly-turned feet at the ends of each of the legs of the bracket, adapted to slideably engage corresponding shoulders adjacent the upper and lower edges of the retainer members. The slidable engagement permits the position of the bracket to be shifted along the length of the panel to align with existing window blind support brackets. The mount may include an L-shaped attachment member adapted to link the L-shaped bracket with the window blind support bracket, In the directional references employed herein, the terms "upwardly" and "downwardly" refer to the valance mounted in a conventional upright position. The terms "rearwardly" and "forwardly" refer to the directions towards and away from a wall, respectively, when the valance is mounted thereto,

DETAILED DESCRIPTION OF THE PREFERRED EMBODIMENTS

Figure 1:
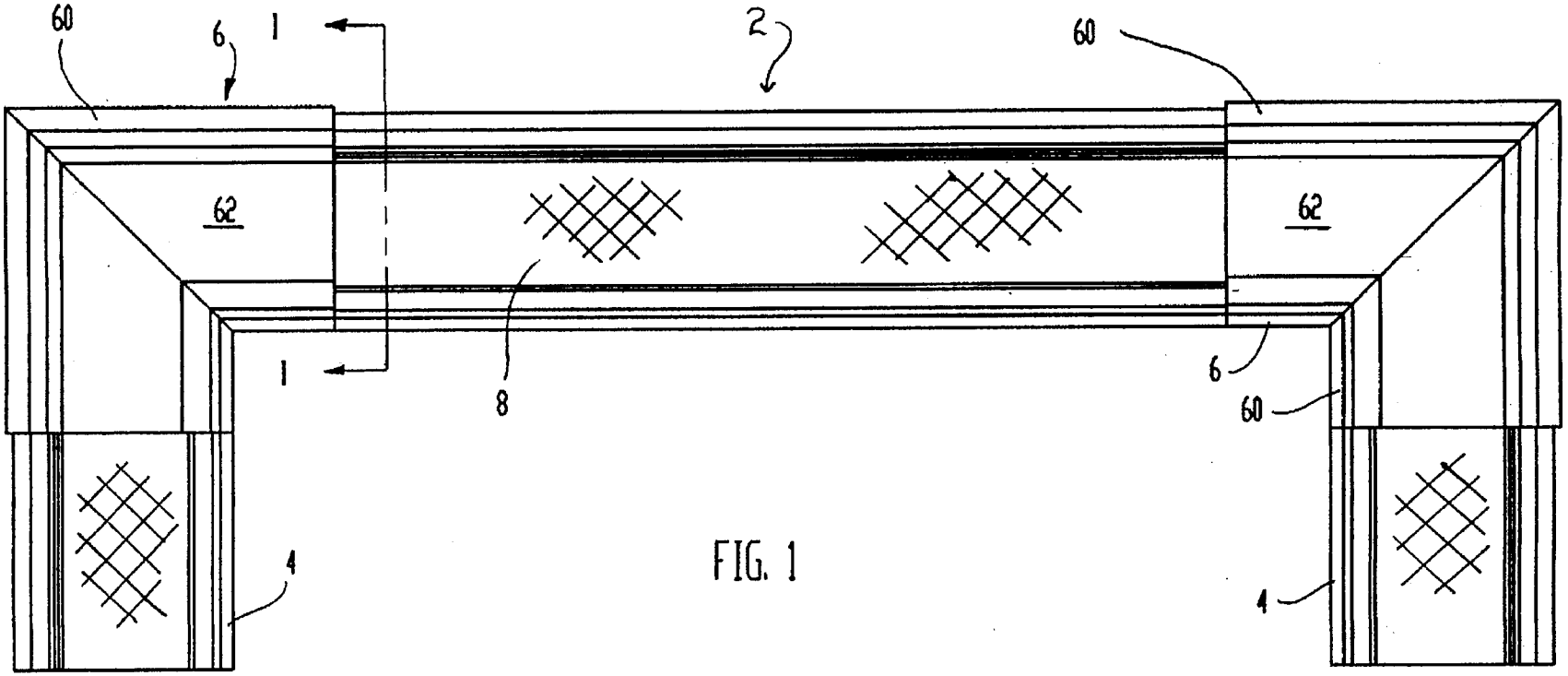
FIG. 1 is a plan view of a first embodiment of the invention, as viewed from the underside.

Referring first to FIG. 1, the invention comprises in general terms a box-like structure having an elongate front panel 2 with side panels 4 at either end thereof extending rearwardly at generally right angles from the front panel. The corners of the valance are capped with corner caps 6.

The front exposed faces of the panels are characterized by decorative inserts 8, described in detail below.

The respective panels are canted outwardly and upwardly at approximately 45 degrees from the vertical when the device is viewed from the front or sides, as seen in FIGS. 2–9. The corner caps 6 of the valance are correspondingly bevelled at their corners, as seen in FIGS. 4–9.

Referring to FIGS. 4–9, three embodiments of the invention are shown, comprising alternative arrangements of the decorative insert and corner caps. The first embodiment has convexly-bowed front and side panel inserts, with squared-off corner caps. The second embodiment differs from the first in having angled corner caps. The third embodiment has concavely-bowed front and side panel inserts and corner caps.

Figure 2:
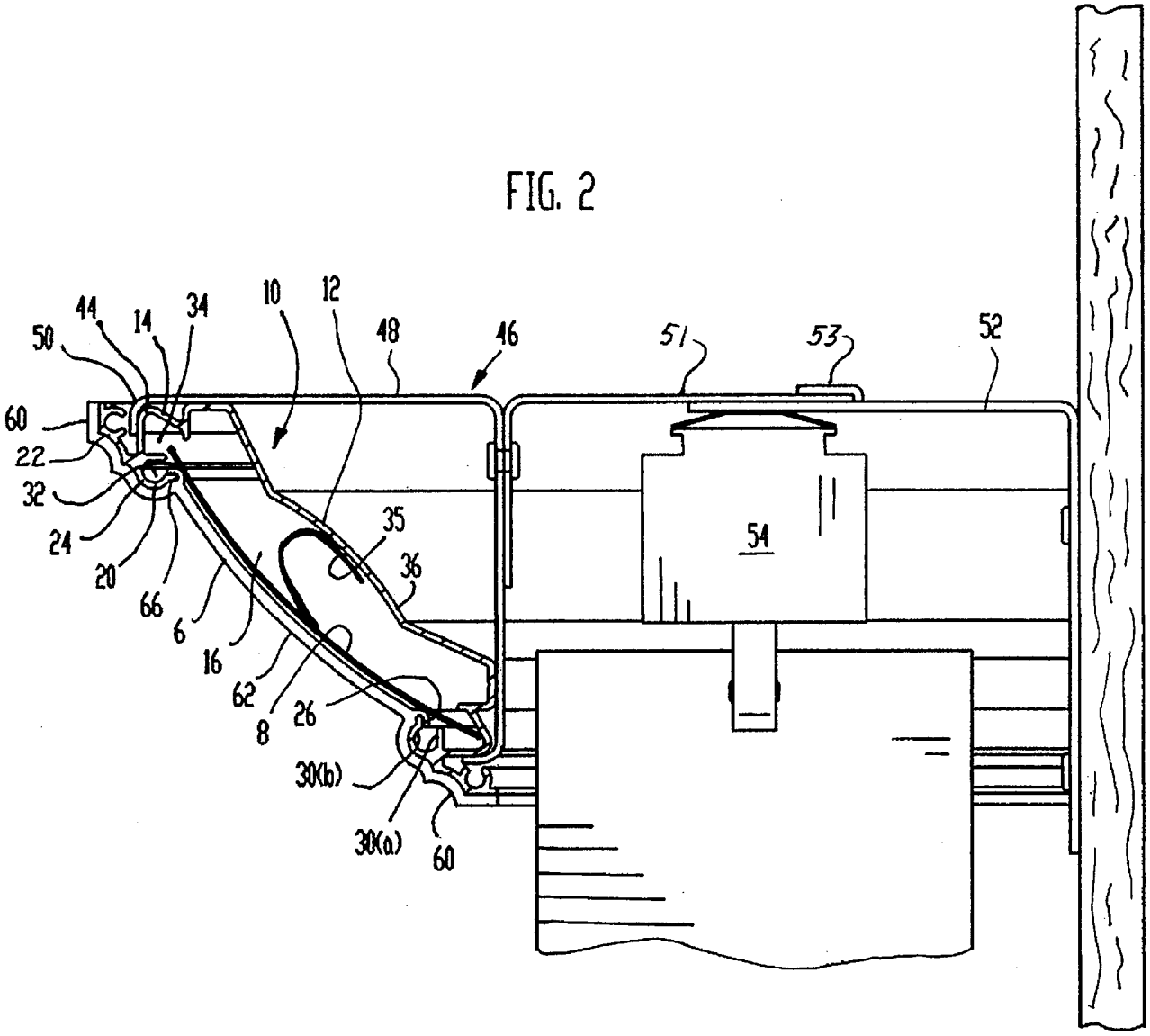
FIG. 2 is a sectional view of the invention, as seen along line I—I of FIG. 1.

Referring to FIG. 2, the side and front panels are each defined by a retainer member 10 common to all three embodiments. The retainer member has a generally U-shaped profile defined by a floor 12 and sidewalls 14. The respective sidewalls define a mouth 16. The sidewalls 14 flare generally outwardly and when seen in section are generally T-shaped. One limb of the top of the "T" forms a lip 20 partly occluding the mouth 16. Together, the two lips are adapted to retain a decorative insert 8 within the channel member. The opposing limb of the "T" defines a flange 22 that forms a decorative border extending outwardly from the mouth of the retainer member. Each lip 20 incorporates a forwardly facing rounded outer face 24 facing away from the mouth of the channel and a rearwardly-facing inner face 26. The inner face comprises a pair of flanges, consisting of a straight inner flange 30(*a*) and an outwardly-bowed outer flange 30(*b*). The two flanges extend rearwardly into the interior of the channel. The free end of the outer flange is slightly flared, to provide a snap-lock engagement means for the corner cap, as will be described in detail below. The inner and outer flanges together define a channel 32 that extends the length of the panel. The rounded outer face facilitates installation of the decorative insert while the flanges of the inner face retains a decorative insert in position within the channel.

An outer portion of each of the sidewalls 14 bulges outwardly, and defines a recess 34 within the interior of the mouth 16. The recess is adapted to cooperate with the lip 20 to retain a decorative insert, as will be described below.

Figure 3:
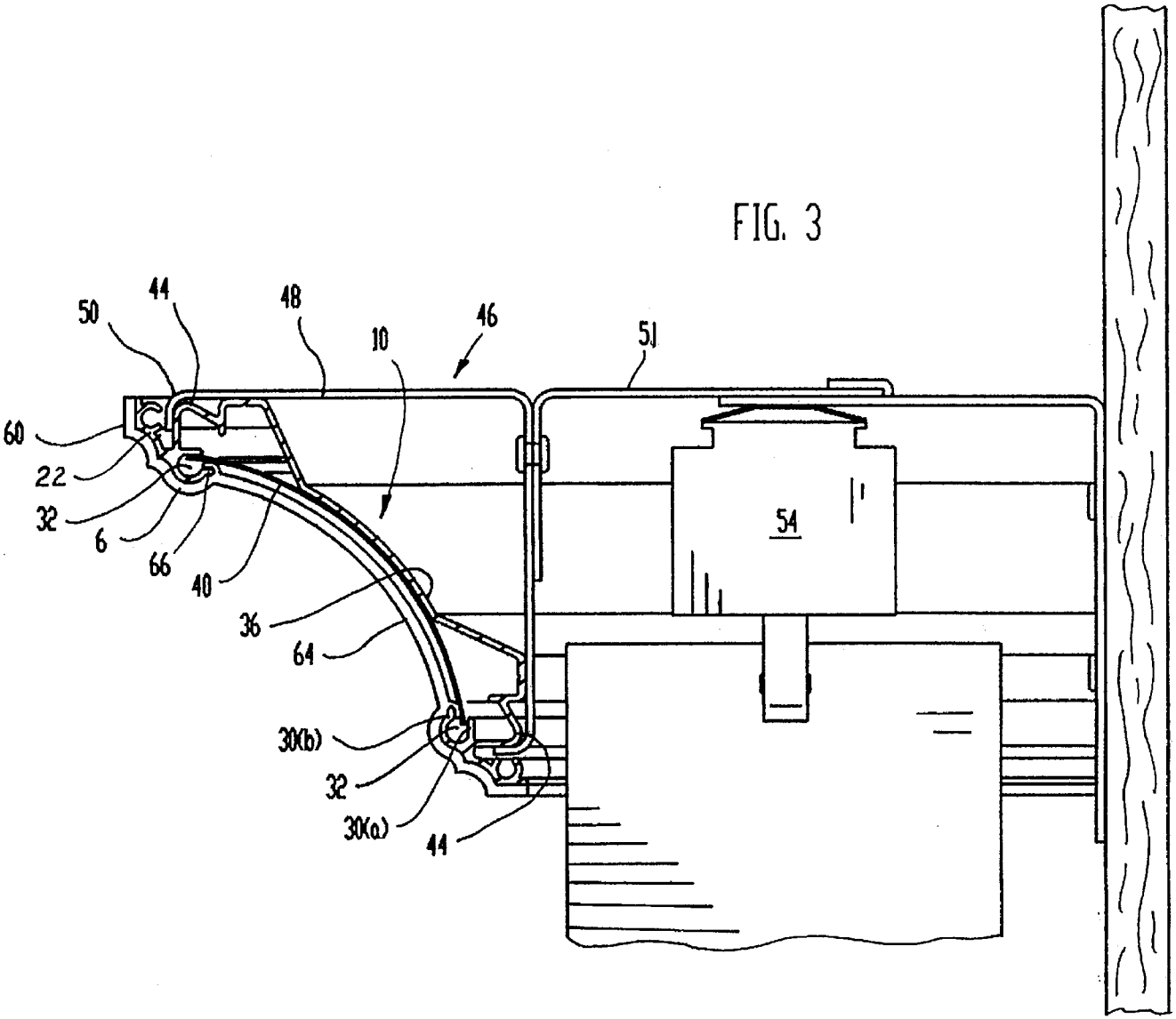
FIG. 3 is a sectional view as in FIG. 2 of a second embodiment of the invention.

The floor of the retainer member incorporates a concave center portion 36 to cradle a concavely-positioned decorative insert 40, as seen in FIG. 3.

Decorative inserts 8, 40 may be retained within the retainer members in either of two alternative positions. In the first and second embodiments, an insert 8 is bowed outwardly along its longitudinal axis. In these versions, the insert comprises a generally striplike sheet which will typically comprise a strip of the same material as comprises the vanes of a window blind extending from the valance. The insert is installed by inserting the side edges of the panel behind the lips 20, as seen in FIG. 2. Depending on the rigidity of the insert, it may be either snapped into position from the front of the retainer member, or slid into position from the side. Once inserted, the side edges of the panel are retained behind the flanges 30. One or both of the recesses 34 receives a side edge of the insert. The insert is biased outwardly against the lips 20 by means of an array of biasing means 35, which can comprise simply small strips of the insert material that have been folded over and positioned between the insert and the floor of the retainer member.

The same retention means may also be used to retain a generally planar insert, not shown.

Figure 6:
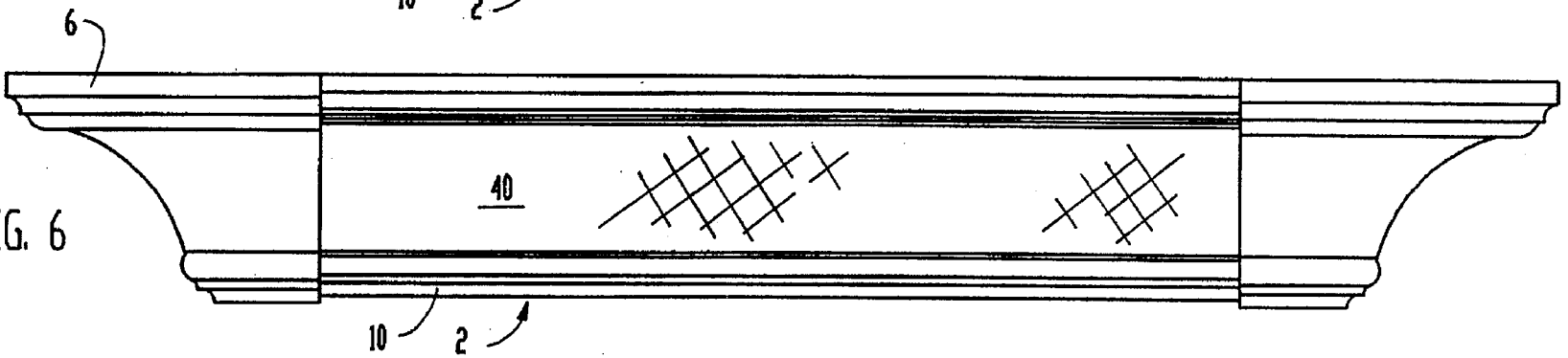
FIG. 6 is a front elevational view of a third embodiment of the invention.
Figure 9:
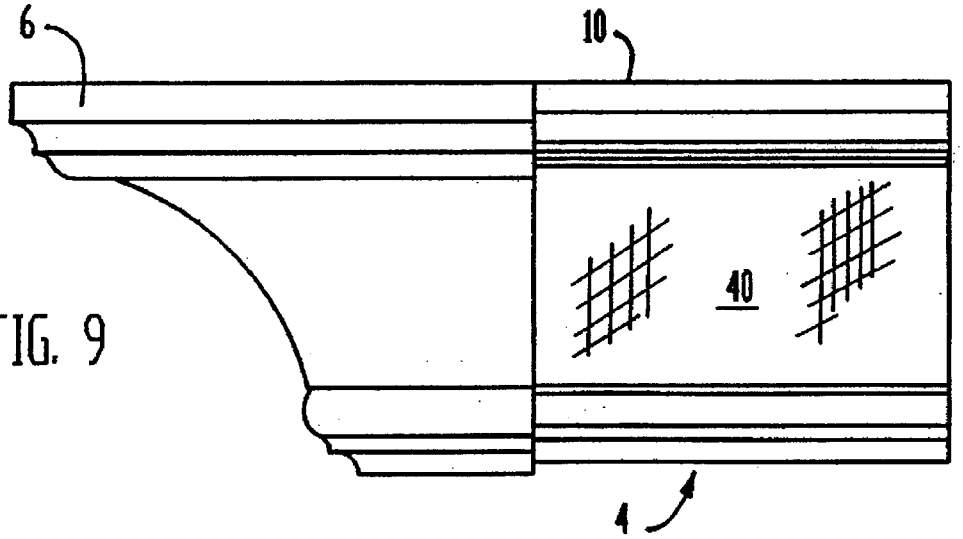
FIG. 9 is a side elevational view of the third embodiment.

In the third embodiment, shown in FIGS. 3, 6 and 9, an insert 40 is retained in a concave position. An insert retained in this position may comprise either a generally rigid sheet or one that is relatively flexible, for example an insert comprised of a stiffened fabric or a fabric/plastic composite. The concave retention prevents this type of insert from sagging or inadvertently releasing. For this version, the side edges of the insert are both inserted within the channels 32 formed by the flanges 30. The insert may be either slid sideways into position or, if the valance is already installed, the insert may be flexed along its elongate axis and fitted into position from the front.

As seen in FIGS. 2 and 3, the sidewalls that define the upper and lower margins of the retainer member each curve inwardly adjacent their free ends to form a shoulder 44. The respective shoulders slideably engage a mounting bracket 46 that mounts the valance to a mounting support of a window blind or curtain. The mounting bracket 46 is in two parts, the first being a rigid L-shaped first part 48 that comprises two legs each terminating in an inwardly-turned foot 50. The feet each slideably engage and are retained by a corresponding shoulder 44. A second part 51 is attached to the first part, and comprises a rigid L-shaped member, one leg of which is bolted to the first part, and the second leg of which is adapted to be releasably retained within a channel 53 on the upper face of a window blind mounting bracket 52.

The corner caps 6, seen in cross-section in FIGS. 2 and 3, are snap-locked to the retainer members. Each corner cap is generally L-shaped when seen in plan view, as in FIG. 1. The caps each comprise upper and lower edges 60 and a faceplate 62, 64 that in the first and second embodiments is outwardly-bowed and in the third embodiment bows inwardly. The faceplate has a profile that corresponds generally with that of the decorative insert 8, 40 and the profiles of the edges generally match those of the decorative border flanges 22, with the cross-sectional profile of the corner cap being somewhat larger than that of the corresponding elements of the channel members to achieve a stepped appearance.

A curved flange 66 extends along the inside of the edges and mates with the outwardly-flared portion of the outer flange 30(*b*) of the lip 20, to permit the cap to snap-lock onto the retainer member.

The faceplate 62 of the first and second embodiments, seen in FIG. 2 is shaped to permit an outwardly-bowed decorative insert to be received between the cap and the retainer member. The insert may be positioned under the cap by simply sliding the insert into position under the cap or, alternatively, the cap may be snap-locked into position over the insert after the insert has been installed within the retainer member. The snap-lock engagement of the cap to the retainer member permits the insert to be easily replaced or installed after installation of the valance.

In the third embodiment, seen in FIG. 3, the faceplate 64 bows inwardly to accommodate a concavely-arced insert. A gap is maintained between the faceplate and the floor of the retainer member sufficient to permit the insert to slide therebetween.

Figure 4:
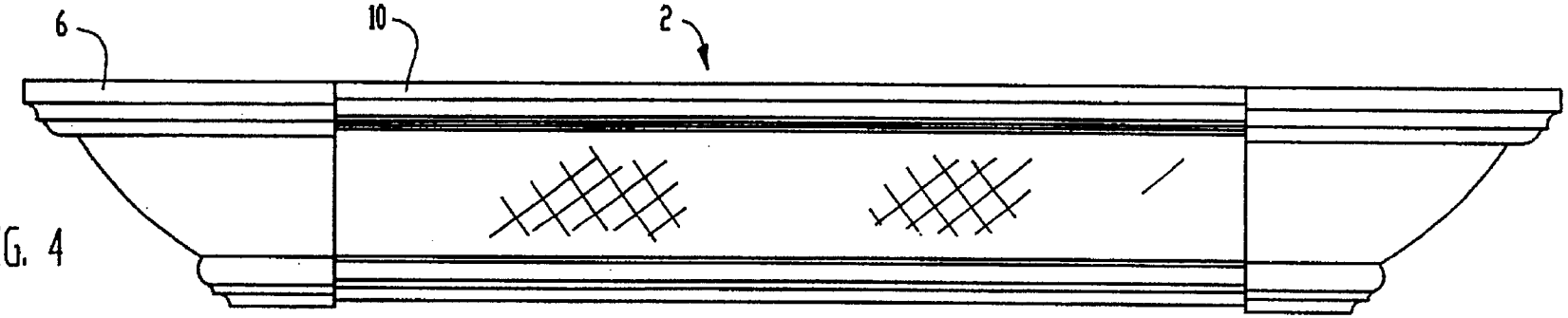
FIG. 4 is a front elevational view of the first embodiment.
Figure 5:
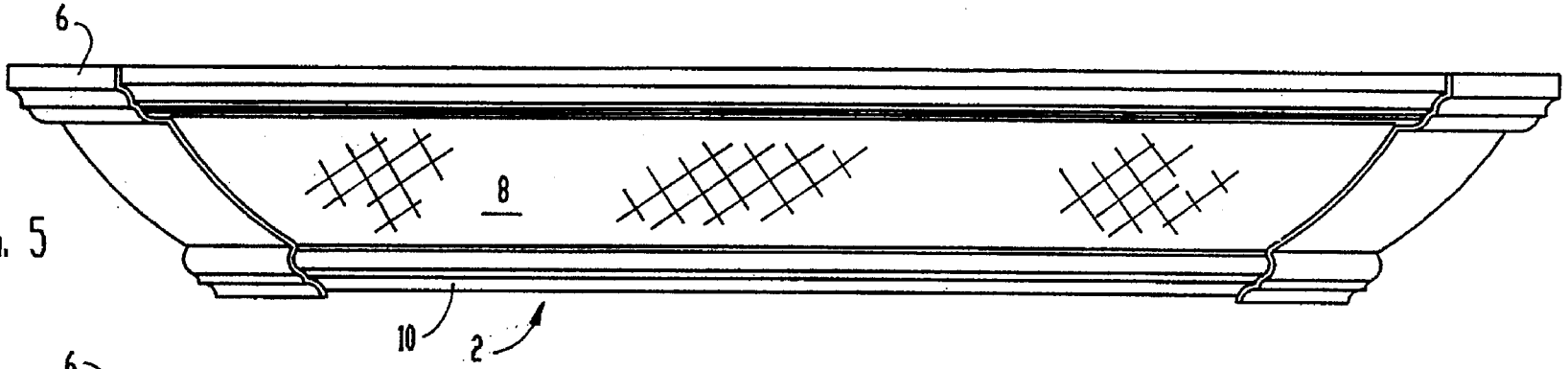
FIG. 5 is a front elevational view of the second embodiment.
Figure 7:
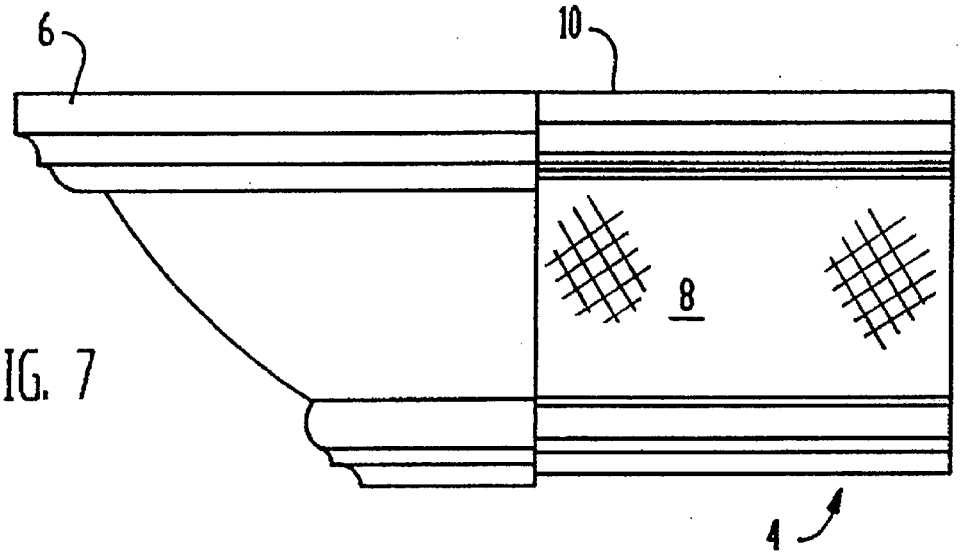
FIG. 7 is a side elevational view of the first embodiment.
Figure 8:
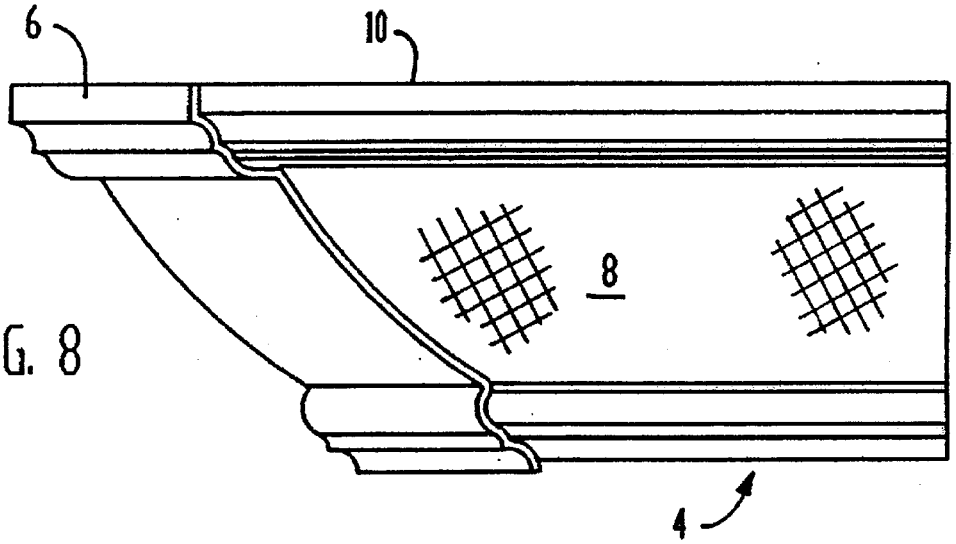
FIG. 8 is a side elevational view of the second embodiment.

The first embodiment, as seen in particular in FIGS. 4 and 7, is characterized by a corner cap wherein the side edges are generally vertical when the cap is engaged to the retainer member. The second embodiment, seen in FIGS. 5 and 8, is characterized by a corner cap whose side edges angle outwardly and upwardly when the valance seen from the front or side, and that are parallel to each other when the valance is viewed from an oblique angle. This effect is achieved by providing a corner member whose two halves have side edges parallel to each other. The third embodiment, seen in FIGS. 6 and 9, is similar to the first embodiment, with the corner members having concavely-bowed faceplates and straight-cut sides.

We claim:

1. A valance for installation against a wall or ceiling, said valance comprising a generally box-like structure defined by elongate front and side panels, said front and side panels each being canted outwardly and upwardly at a generally 45 degree angle and comprising a channel defined by sidewalls and a floor and having an elongate axis extending the length of said channel and an open mouth, said sidewalls each having retainer means to releasably retain a decorative insert within said channel, said insert comprising an elongate striplike sheet having longitudinal edges along the elongate sides thereof, said retainer means comprising a pair of lips partly occluding the mouth of said channel and pair of parallel, spaced apart flanges extending from each of said lips into the interior of said channel and defining a groove therebetween, said retainer means being adapted to selectively retain a longitudinal edge of a decorative insert within each of said grooves in a first position wherein said insert is concavely flexed relative to the floor of said channel along the elongate axis thereof and in an alternative second position wherein said insert is convexly arced and is retained between said lips and the floor of said channel.

2. A valance as in claim 1, wherein there is further provided a generally L-shaped cap covering each corner of said valance, said cap comprised of upper and lower edges and web extending therebetween, said upper and lower edges having snap-lock engagement means to engage said cap to said panels, said web shaped to maintain a spaced-apart relationship between said web and the floor of said channel to permit the insertion of said decorative insert therebetween.

3. A valance as in claim 1 wherein said valance includes a decorative insert comprising an elongate striplike sheet retained within said channel.

4. A valance as in claim 3, wherein said insert is bowed outwardly relative to said channel.

5. A valance as in claim 3, wherein said insert is bowed inwardly relative to said channel.

6. A valance as in claim 1, wherein there is further provided a mounting bracket comprising a rigid generally L-shaped member having engagement means comprising upper and lower generally hook-shaped members adapted to extend at least partly around upper and lower rims respectively of at least one of said panels to slideably engage said at least one panel to said bracket, and having mounting means to fixedly engage said bracket to a window blind mounting bracket.

7. A valance as in claim 6, wherein said engagement means comprises an inwardly-angled foot extending from each end of the first member, each foot adapted to slideably engage a corresponding shoulder defined by an inwardly angled portion of said sidewall.

* * * * *